US005095643A

United States Patent [19]

Fisher

[11] Patent Number: 5,095,643

[45] Date of Patent: Mar. 17, 1992

[54] HANDGUN WITH IMPROVED RECEIVER LOCK, HAMMER MOUNTING, AND SIGHT

[76] Inventor: Jerry A. Fisher, 38 Buffalo Butte, Dubois, Wyo. 82513

[21] Appl. No.: 589,267

[22] Filed: Sep. 28, 1990

[51] Int. Cl.[5] ..... F41A 3/58; F41A 15/06

[52] U.S. Cl. ..... 42/44; 42/41; 42/100

[58] Field of Search ..... 42/44, 64, 100, 41, 42/65, 69.01, 75.03; 33/256, 257, 252

[56] References Cited

U.S. PATENT DOCUMENTS

| | | | |
|---|---|---|---|
| 33,836 | 12/1861 | Gross | 42/65 |
| 395,849 | 1/1889 | Parry | 42/44 |
| 591,291 | 10/1897 | Pieper | 42/44 |
| 601,820 | 4/1898 | Torkelson | 42/44 |
| 758,089 | 1/1904 | Mossberg | 42/44 |
| 1,014,913 | 1/1912 | Singer | 42/44 |
| 2,187,096 | 1/1940 | Pomeroy | 33/257 |
| 2,385,422 | 9/1945 | Rice | 42/65 |
| 2,484,368 | 10/1949 | Young | 33/252 |
| 2,774,143 | 12/1956 | Sunderland | 33/257 |
| 2,874,501 | 2/1959 | Koucky et al. | 42/100 |
| 3,153,873 | 10/1964 | Boudreau | 42/100 |
| 3,662,469 | 5/1972 | Charron | 42/100 |

*Primary Examiner*—Michael J. Carone
*Attorney, Agent, or Firm*—Thorpe North & Western

[57] ABSTRACT

A single shot handgun of the type having a frame, a receiver, a firing chamber in the receiver, a firing pin, a hammer for driving the firing pin, a barrel connected to the receiver being pivotally attached to the frame so that the barrel and receiver can be pivoted from a battery position to an open position. A mechanism for locking the receiver in the battery position comprises a longitudinal slot cut into the rearward end of the receiver. A longitudinal, second slot is cut into the face of the frame that abuts the rearward end of the receiver when the receiver is in the battery position. A longitudinal lug is received in the second slot, with the lug being slidable into a forward position wherein it makes engagement with the slot in the receiver to lock the receiver in its battery position. Finger engagements are provided at the ends of the lug for withdrawing the lug from engagement with the slot in the receiver to allow the receiver to pivot to its open position. Also provided are an improved structure for mounting the hammer in the frame of the handgun, an improved gun sight, and an improved structure for mounting the gun handle.

13 Claims, 3 Drawing Sheets

HANDGUN WITH IMPROVED RECEIVER LOCK, HAMMER MOUNTING, AND SIGHT

BACKGROUND OF THE INVENTION

1. Field of the Invention

The present invention relates improvements in the construction and operation of handguns and in particular to improvements, among others, in a mechanism for mounting the hammer in the frame of a handgun and a locking mechanism for a single shot, breech opening handgun.

2. State of the Art

Single shot handguns are well known. Breech opening handguns are also known in the prior art. Such handguns generally incorporate a frame, a breech block, a cylindrical firing chamber that extends through the breech block and has a discharge opening in the forward end and a breech opening in the rearward end, a firing pin extending from a face of the frame that abuts the rearward end of the breech block, with the firing pin being in alignment with the firing chamber, a hammer for driving the firing pin, a barrel connected to the forward end of the breech block in alignment with the discharge end of the firing chamber, and means for pivotally attaching the breech block to the frame so that the barrel and breech block can be pivoted from a battery position to an open position for removing a spent round from and inserting an unfired round into the breech opening in the breech block. Various locking means have been utilized to lock the breech block in the battery position. Generally, some type pivoting lock arm on the frame of the handgun is adapted to engage a lock pin or catch in the breech block. Such locking means are cumbersome, difficult to use, and adversely effect the accuracy of the handgun due to excess play in the locking means.

Various means have been used to mount the hammer of a handgun in the frame. Generally, the hammer has a pivot axle that must be incorporated with the hammer and then installed in the frame of the gun. Costly machining is required for the hammer, the numerous parts necessary in the assembly, and for the hammer receiving cavity in the frame. Further, the assembly of the hammer is labor intensive and must be done by skilled labor.

Various means have been used to mount a handle to the frame of the gun, but there has been no suggestion of utilizing means for mounting the handle to the frame which also provides for incorporation of an elongate, coil spring for biasing the hammer to its fired position when the trigger is pulled. Generally, handguns utilize a leaf spring system that are cumbersome and increase the complexity of the assembly of the handgun.

Gun sights are, of course, used on all handguns. In the past, however, the sights have generally been non-adjustable. In highly skilled target practice, it would be highly advantageous to provide an adjustable rear sight which could be fine tuned by the shooter to existing conditions.

3. Objectives

A principal objective of the invention is to provide a breech opening handgun having an improved locking mechanism that securely holds the breech block and the barrel extending therefrom firmly in the battery position with essentially no play in the locking mechanism.

Another objective of the present invention is to provide such an improved locking mechanism for a breech opening handgun that requires two fingered operation which minimizes the likelihood of inadvertent unlocking and positively eliminates the possiblity of inadvertently firing the gun at the same time as unlocking the breech.

A further objective of the present invention is to provide improved means for mounting the hammer of a handgun in the frame which utilizes a cylindrical disc that fits snugly in the mounting cavity adjacent to the hammer and has an outer face that is in alignment with the side of the frame of the gun.

A still further objective of the present invention is to provide improved means for mounting the handle to the frame, wherin the handle mounting means also provides for incorporation of an elongate, coil spring for biasing the hammer to its fired position when the trigger is pulled.

An additional objective of the present invention is to provide a simple but effective back sight for a handgun which allows adjustment of the sight notch back and forth along a direction substantially transverse of the barrel of the handgun.

BRIEF DESCRIPTION OF THE INVENTION

The above objectives are achieved in accordance with the present invention by providing novel improvements to a handgun of the type having a frame, a receiver, a cylindrical firing chamber that extends through the receiver, a firing pin extending from the frame at the breech opening in the receiver, a hammer for driving the firing pin, a barrel, and means for pivotally attaching the receiver to the frame so that the barrel and receiver can be pivoted from a battery position to an open position for removing a spent round from and inserting an unfired round into the breech opening in the receiver.

One improvement in accordance with the invention provides novel means for releasable locking the receiver in a firing position. A longitudinal slot is cut into the rearward end of the receiver below the breech opening. The slot preferably has a substantially rectangular cross-sectional shape. A longitudinal, second slot is cut into the face of the frame that abuts the rearward end of the receiver when the receiver is in the battery position. The second slot preferably has a substantially rectangular cross-sectional shape, with the second slot being in parallel, abutting alignment with the slot in the receiver when the receiver is in the battery position.

A longitudinal lug is received longitudinally within the second slot. The lug preferably has a substantially rectangular cross-sectional shape and a size to fit snugly into second slot. Biasing means, such as a spring, are provided for sliding the lug lenthwise into a forward position wherein it can make longitudinal engagement with the slot in the receiver to lock the receiver in its firing position. The snug fit of the rectangular shaped lug into the similiar shaped slot in the receiver results in an exceptionally stable interlocking of the receiver and the frame so as to eliminate essentially any play between the receiver and the frame.

Of course, means are provided for withdrawing the lug from engagement with the slot in the receiver to allow the receiver to pivot to its open position. Preferably, a pair of finger engagements are attached to the opposite, elongate ends of the lug so that the finger engagements slide along exterior sides of the frame in a direction away from the receiver to withdraw the lug from engagement with the slot in the receiver. The pair of finger engagements requires two fingered operation and thus minimizes the likelihood of inadvertent unlocking of the receiver. Inadvertent firing of the gun at the same time as unlocking the receiver is eliminated entirely.

Several additional improvements provided by the present invention will be described in detail hereinafter. In brief, one such additional improvement comprises novel means for mounting the hammer in the frame of the handgun. A substantially circular shaped mounting cavity extends inwardly into the frame from one side thereof. The mounting cavity has a flat inner bottom face, and the circular body portion of the hammer can be received within the mounting cavity to lie against the bottom face thereof. A pivot post extends from the bottom face completely through a central opening in the circular body portion of the hammer.

A cylindrical disc fits snugly in the mounting cavity adjacent to the hammer, with the cylindrical disc having an outer face that is in alignment with the one side of the frame and an inner face abutting the circular portion of the hammer. The portion of the pivot post extending from the hammer is received in a central bore on the inner face of the cylindrical disc.

Additional objects, features, and improvements of the invention will become apparent from the following detailed description, taken together with the accompanying drawings.

THE DRAWINGS

Preferred embodiments of the improvements of the present invention representing the best mode presently contemplated of carrying out the invention are illustrated in the accompanying drawings in which.

DETAILED DESCRIPTION OF THE ILLUSTRATED EMBODIMENTS

Figure 1:
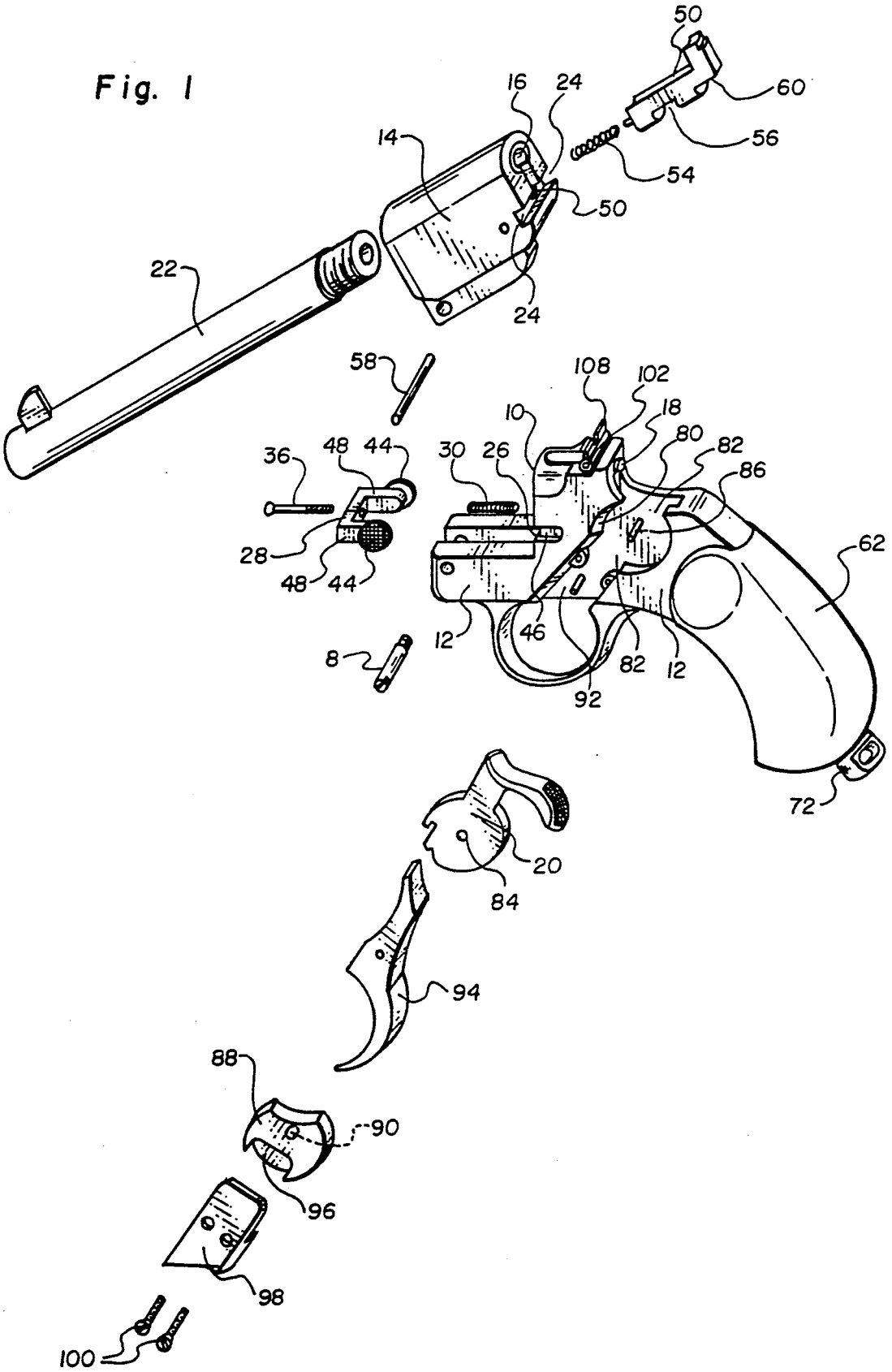
FIG. 1 is an exploded, pictorial representation of a handgun embodying various of the improvements of the present invention.
Figure 2:
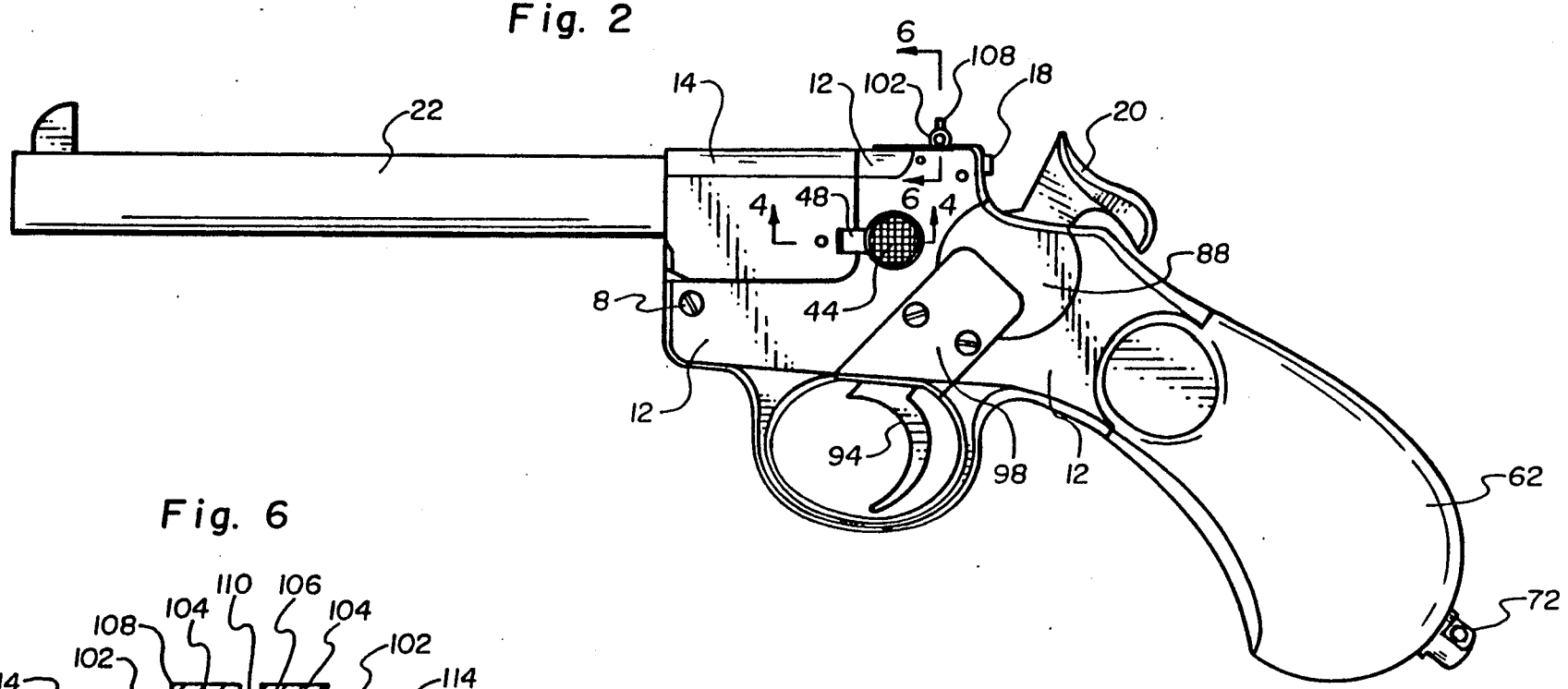
FIG. 2 is a side elevation of the handgun of FIG. 1.
Figure 6:
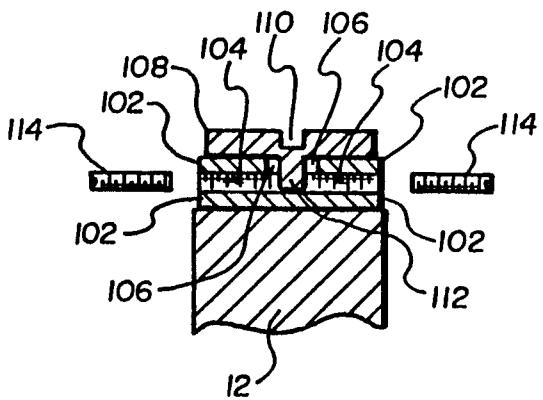
FIG. 6 is a vertical cross section taken along lin 6—6 of FIG. 2 through the improved gun sight in accordance with the invention.

Referring now to the drawings there is illustrated a single shot handgun of the breech opening type. The gun comprises a frame 12 and a receiver 14. The receiver 14 has incorporated therein a cylindrical firing chamber 16 that extends through the receiver 14 and has a discharge opening in the forward end of the receiver 14 and a breech opening in the rearward end of the receiver. A firing pin 18 extends from a breech block 10 of the frame 12 that abuts the rearward end of the receiver 14, with the firing pin 18 being in alignment with the firing chamber 16. A hammer 20 is provided for driving the firing pin 16, and a barrel 22 is connected to the forward end of the receiver 14 in alignment with the discharge end of the firing chamber 16. The receiver 14 is pivotally attached to the frame 12 by a pivot pin 8 so that the barrel 22 and receiver 14 can be pivoted from a battery position in which the rearward end of the receiver 14 abuts the breech block 10 of the frame 12 to an open position for removing a spent round from and inserting an unfired round into the breech opening in the receiver 14.

One aspect of the present invention is directed to an improvement in means for releasable locking the receiver 14 in a battery position. As illustrated, a longitudinal slot 24 is cut into the rearward end of the receiver 14 below the breech opening. The slot 24 has a substantially rectangular cross-sectional shape and extends across the full width of the receiver 14. The slot 24 opens along its length toward the breech block 10 of the frame 12 when the receiver 14 is in the battery position.

A longitudinal, second slot 26 is cut into the breech block 10 of the frame 12. The second slot 26 has a substantially rectangular cross-sectional shape and extends across the full width of the breech block 10 of the frame 12. The second slot 26 is in parallel with and makes abutting alignment with the slot 24 in the receiver 14 when the receiver is in the battery position.

A longitudinal lug 28 having a substantially rectangular cross-sectional shape and a size substantially the same as the second slot 26 is received in and is adapted to occupy the second slot 26. Means are provided for sliding the lug 28 into a forward position wherein it extends partly from the second slot 26 and makes engagement with the slot 24 in the receiver 14 to securely lock the receiver 14 in its battery position. In addition, means are provided for withdrawing the lug 28 from engagement with the slot 24 in the receiver 14 to allow the receiver to pivot to its open position.

In the preferred embodiment illustrated in the drawings, the means for sliding the lug 28 into its forward position comprises a spring 30 that biases the lug 28 toward its forward position. The spring 30 is received in a spring receiving bore 32 that extends into the frame 12 from an open end at an inner side of the second slot 26. The spring 30 is a coil spring having an elongate axis, and the spring 30 is mounted in the spring receiving bore 32 with one end thereof abutting the closed inner end of the spring receiving bore 32 and with the other end thereof engaging the lug 28.

A passage 34 is provided in the lug 28, with the passage 34 being in alignment with the elongate axis of the coil spring 30 and bore 32. An elongate retainer pin 36 extends through the passage 34 and the coil spring 30, with the retainer pin 36 being anchored to the frame 12 at the inner end of the spring receiving bore 32, whereby the retainer pin 36 allows limited sliding movement of the lug 28 to its forward position but securely retains the lug 28 from disengagement from the frame 12.

Figure 4:
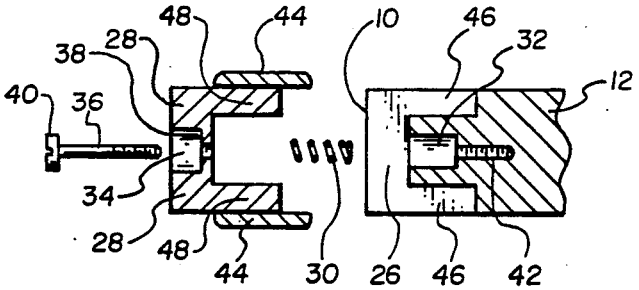
FIG. 4 is an exploded, partial cross section through the front face portion of the frame taken along line 4—4 of FIG. 2.

As best shown in FIG. 4, the passage 34 has a smaller diameter portion opening toward the frame 12 of the gun and a larger diameter portion opening away from the frame 12. A circular ledge 38 is formed at the juncture of the smaller diameter portion and larger diameter portion of the passage 34. The retainer pin 36 is threaded at it lead end and has a head 40 which can be engaged by a screw driver. The head 40 is slightly larger in diameter than the pin 36 itself. The pin 36 extends through the passage 34, the coil spring 30 and the spring receiving bore 32 for threading to a threaded well 42 at the closed inner end of the spring receiving bore 32. The head 40 of the pin 36 engages the ledge 38 in passage 34 to retain the lug 28 to the frame 12. The pin 36 is just long enough to allow the lug 28 to make limited sliding movement back and forth along the pin 36.

The means for withdrawing the lug 28 from engagement with the slot 24 in the receiver 14 preferably comprises a pair of finger engagements 44 and means for coupling the finger engagements 44 to the opposite, elongate ends of the lug 28 so that the finger engagements 44 are slidable along exterior sides of the frame 12 in a direction away from the receiver 14 to withdraw the lug 28 from engagement with the slot 24 in the receiver 14. The pair of finger engagements 44 requires two fingered operation and thus minimizes the likelihood of inadvertent unlocking of the receiver 14. Inadvertent firing of the gun at the same time as unlocking the receiver 14 is effectively eliminated entirely.

The means for coupling the finger engagements to the lug 28 preferably comprises a pair of elongate side slots 46 formed in the exterior sides of the frame 12 and extending from the second slot 26 in a direction away from the receiver 14. A pair of side arms 48 extend from the opposite ends of the lug 28, with the side arms 48 being received in the respective side slots 46 for sliding movement therein. The finger engagements 44 are connected to the extending, respective ends of the side arms 48 for sliding movement along the respective sides of the frame 14.

Figure 5:
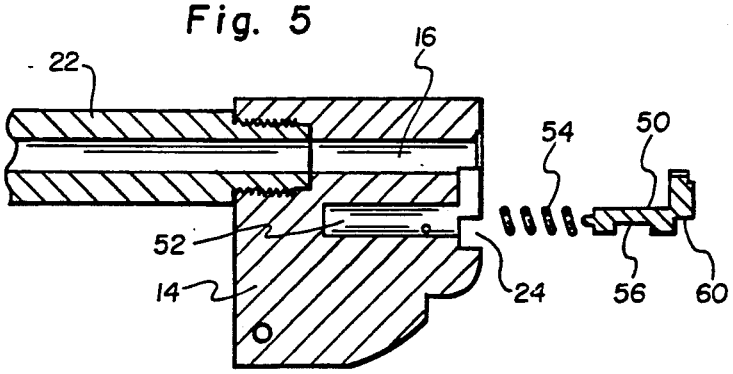
FIG. 5 is a vertical cross section through the receiver and part of the barrel showing a push member in the front face of the receiver in exploded postion.

The handgun can further include a spring loaded push member 50 mounted in the rearward end of the receiver 14. The push member 50 exerts a force on the breech block 10 of the frame 12 abutting the rearward end of the receiver 14 when the receiver is in the battery position. As best illustrated in FIG. 5, the push member 50 is received longitudinally in bore 52. The bore 52 can intersect the slot 24 in the receiver 14. A spring 54 is received in the closed end of the bore 52, and the push member 50 fits in the bore 52 to compress the spring 54. A slot 56 in the side of the push member 50 receives a retention pin 58 (FIG. 1) that extends through the receiver 14 to retain the push member 50 in the bore 52. The projecting end of the push member 50 can have a notch 60 formed therein that corresponds with the portion of the slot 24 in the receiver 14 that is intersected by the bore 52 and the push member 50.

Another improvement in a handgun in accordance with the present invention comprises improved means for mounting a handle 62 to the frame 12. A first end of an elongate cylindrical shaft 64 is attached to the frame 12 at an end of the frame 12 opposite the breech block 10 that abuts the receiver 14. The other end of the shaft 64 extends away from the frame 12. The handle 62 has an inner end that abuts the end of the frame 12 and an outer end that extends away from the frame 12. An elongate receiving bore 66 extends from the inner end of the handle 62 toward the outer end thereof. The handle 62 and the receiving bore 66 thereof are adapted to slide over the shaft 64, and appropriate means are provided for securing the handle 62 to the shaft 64.

The means for securing the handle 62 to the shaft 64 comprises a threaded bore 68 in the oppósite end of the shaft 64. A screw receiving opening 70 is provided in the outer end of the handle 62, with the screw receiving opening 70 being in alignment with the threaded bore 68 in the shaft 64. A threaded screw 72 extends through the screw receiving opening 70 and engages the threaded bore 68 in the shaft 64 to securely hold the handle 62 to the shaft 64, with the inner end of the handle 62 firmly abutting the frame 12.

Figure 3:
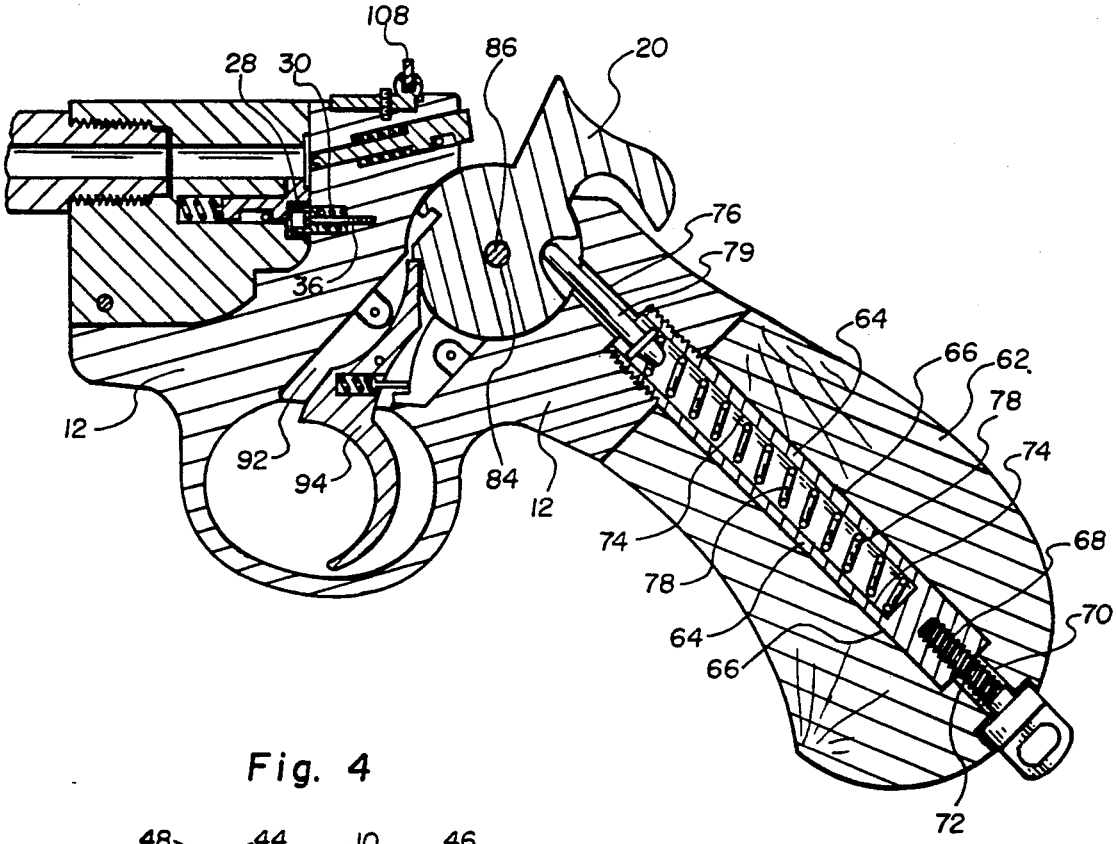
FIG. 3 is an enlarged, partial, vertical cross section through the hammer, trigger, and handle portion of the handgun of FIG. 2.

The shaft 64 is further advantageously modified to house an improved spring means for biasing the hammer 20 of the handgun. An elongate hollow core 74 is formed in the cylindrical shaft 64, with the hollow core 74 extending from the one end of the shaft 64 which is attached to the frame 12 toward the other end of the shaft. An open passage 76 in the frame 12 extends from the end of the shaft 64 to the hammer 20, and a coil spring 78 is positioned in the hollow core 74 of the shaft 64. The coil spring 78 in the hollow core 74 is coupled through a push rod 80 to the hammer 20 to bias the hammer to a fired position. As illustrated in FIG. 3 of the drawings, the push rod 80 has one end that engages the hammer 20, with the other end engaging the coil spring 78 in the hollow core 74.

Another aspect of the invention provides a handgun that further includes improved means for mounting the hammer 20 in the frame 12 of the handgun. As shown in FIG. 1 of the drawings, a substantially circular shaped mounting cavity 80 extends inwardly into the frame 12 from one side thereof. The mounting cavity 80 has a flat inner bottom face 82, and the circular body portion of the hammer 20 is received within the mounting cavity 80 to lie against the bottom face 82 thereof. A pivot post 86 extends into the mounting cavity 80 from the bottom face 82. The pivot post 86 projects through a central opening 84 in the circular body portion of the hammer 20. The circular body portion of the hammer 20 is thus received over the pivot post 86, and the pivot post 86 has sufficient length to extend completely through the central opening 84 from one side and to project from the other of the circular body portion of the hammer 20.

A cylindrical disc 88 fits snugly in the mounting cavity 80 adjacent to the circular body portion of the hammer 20. The cylindrical disc 88 has an outer face that is in alignment with the one side of the frame 12. The outer face of cylindrical disc 88 is finished like the side of the frame 12 and actually forms the side of the frame covering the mounting cavity 82 in the frame. The inner face of the disc 88 lies flat against the circular portion of the hammer 20. The portion of the pivot post 86 projecting from the opening 84 in the hammer 20 is received in a central bore 90 on the inner face of the disc 88. Means are provided for retaining the cylindrical disc 88 in the mounting cavity 80 to close the mounting cavity and finish the side of the frame 12 in the area of the mounting cavity.

The means for retaining the cylindrical disc 88 in the mounting cavity 80 preferably comprises a recessed area 92 cut in the side of the frame 12 adjacent to the mounting cavity 80. The trigger 94 of the gun is advantageously received in this recessed area 92 to interact in known manner with the circular body portion of the hammer 20. A shallow recess 96 is cut in the outer face of the cylindrical disc 88, with the shallow recess 96 being in abutting alignment with the recessed area 92 in the side of the frame 12. A retainer plate 98 has a first portion that fits in the recessed area 92 and an integral second portion extending from the first portion that fits in the shallow recess 96 on the cylindrical disc 88. Two screws 100 are conveniently provided for securing the retainer plate 98 to the frame 12 to complete the side surface of the frame 12 at the recessed area 92.

In another aspect of the invention, an improved gun sight is provided. The gun sight comprises a base tube 102 having a threaded bore 104 extending from one end to the other end thereof. The base tube 102 is firmly attached along one side thereof to the frame 12 near the rearward end of the receiver 14 so that the threaded bore 104 of the base tube 102 is aligned substantially transverse of the barrel 22 of the handgun when the barrel 22 and receiver 14 are in the battery position.

An elongate slot 106 is formed in the central portion of the base tube 102. The slot 106 opens upwardly from the threaded bore 104 to an upper side of the base tube 102 opposite the one side of the base tube 102 that is attached to the frame 12. A sight blade 108 is provided having a sight notch 110 therein and a tab 112 extending from the blade 108 from a side thereof opposite the sight notch 110. The blade 108 is positioned along the upper side of the base tube 102, with the tab 112 received in the slot 106 in the base tube 102 and extending into the threaded bore 104. Two set screws 114 are threaded into the threaded bore 104 from the opposite ends thereof to make firm engagement with the tab 112 on the blade 108. The set screws 114 can be adjusted to move the sight blade 108 and the sight notch 110 therein back and forth along a direction substantially transverse of the barrel 22 of the handgun when the barrel 22 and receiver 14 are in the battery position.

Although preferred embodiments of a handgun in accordance with present invention have been illustrated and described, it is to be understood that the present disclosure is made by way of example and that various other embodiments are possible without departing from the subject matter coming within the scope of the following claims, which subject matter is regarded as the invention.

I claim:

1. In a single shot handgun of the type having a frame, a receiver having forward and rearward ends, a cylindrical firing chamber that extends through the receiver and has a discharge opening in the forward end an a breech opening in the rearward end, a firing pin extending from a face of said frame that abuts the rearward end of said receiver, with said firing pin being in alignment with the firing chamber, a hammer for driving the firing pin, a barrel connected to the forward end of the receiver in alignment with the discharge end of the firing chamber, and means for pivotally attaching the receiver to the frame so that the barrel and receiver can be pivoted from a battery position in which the rearward end of said receiver abuts said face of said frame to an open position for removing a spent round from and inserting an unfired round into the breech opening in the receiver, an improvement in means for releasable locking the receiver in a battery position, said improvement comprising a longitudinal slot cut into the rearward end of the receiver below the breech opening, said slot having a substantially rectangular cross-sectional shape;

a longitudinal, second slot cut into the face of the frame that abuts the rearward end of said receiver when the receiver is in the battery position, said second slot having a substantially rectangular cross-sectional shape, with said second slot being in parallel, abutting alignment with the slot in said receiver when the receiver is in the battery position;

a longitudinal lug having a substantially rectangular cross-sectional shape and a size to substantially occupy said second slot;

means for sliding said lug into a forward position wherein it can make engagement with said slot in said receiver to lock the receiver in its battery position, said means for sliding comprising a spring;

a spring receiver bore extending into the frame having an open end at a side of said second slot and a closed inner end in said frame, the spring comprising a coil spring having an elongate axis and being mounted in said spring bore with one end thereof abutting the inner end of said spring bore and the other end thereof engaging said lug; and means for withdrawing said lug from engagement with said slot in said receiver to allow the receiver to pivot to its open position.

2. A single shot handgun in accordance with claim 1, wherein a passage extends through said lug in alignment with the elongate axis of said coil spring, and an elongate retainer pin extends through said passage and through said coil spring, with the retainer pin being anchored to the frame at the inner end of said spring bore, whereby said retainer pin allows limited sliding movement of said lug to its forward position but retains the lug from disengagement from said frame.

3. A single shot handgun in accordance with claim 2, wherein the means for withdrawing said lug from engagement with said slot in said receiver comprises a pair of finger engagements and means for coupling the finger engagements to the opposite, elongate ends of said lug so that said finger engagements are slidable along exterior sides of said frame in a direction away from said receiver to withdraw said lug from engagement with said slot in said receiver.

4. A single shot handgun in accordance with claim 3, wherein the means for coupling the finger engagements to said lug comprises a pair of elongate side slots formed in the exterior sides of said frame and extending from said second slot in a direction away from said receiver; and a pair of side arms extending from the opposite ends of said lug, with said slide arms being received in the respective side slots for sliding movement therein, wherein said finger engagements are connected to the extending, respective ends of said side arms for sliding movement along the respective sides of said frame.

5. A single shot handgun in accordance with claim 4 further including a spring loaded push member mounted in the rearward end of said receiver, said push member exerting a force on the face of said frame that abuts the rearward end of said receiver when the receiver is in the battery position.

6. A single shot handgun in accordance with claim 3 further including improved means for mounting a handle to the frame comprising an elongate cylindrical shaft having one end attached to said frame at an end of said frame opposite the face that abuts said receiver, with the other end of said shaft extending away from said end of the frame;

a handle having an inner end that abuts said end of the frame and an outer end extending away from said frame;

an elongate receiving bore extending from said inner end of said handle for sliding over said shaft; and means for securing the handle to said shaft.

7. A single shot handgun in accordance with claim 6, wherein the means for securing the handle to said shaft comprises a threaded bore in the opposite end of said shaft;

a screw receiving opening in said outer end of said handle, said screw receiving opening being in alignment with said threaded bore in said shaft; and a threaded screw extending through the screw receiving opening and engaging said threaded bore in said shaft to securely hold the handle to the shaft with the inner end of said handle firmly abutting said frame.

8. A single shot handgun in accordance with claim 6, further including improved spring means for biasing the hammer of the handgun, said improved spring means comprising an elongate hollow core in said cylindrical shaft, said hollow core extending from the one end of said shaft toward the other end thereof;

an open passage in said frame extending from the one end of said shaft to the hammer;

a coil spring positioned in the hollow core of said shaft; and means for coupling the coil spring in said hollow core to said hammer to bias the hammer to a fired position.

9. A single shot handgun in accordance with claim 8, wherein said means for coupling the coil spring to said hammer comprises a push rod having one end engaging said hammer and the other end engaging said coil spring in said hollow core.

10. A single shot handgun in accordance with claim 3 further including improved means for mounting the hammer in said frame comprising a substantially circular shaped mounting cavity extending inwardly into said frame from one side thereof, with the mounting cavity having a flat inner bottom face, such that a circular body portion of the hammer can be received within said mounting cavity and against the bottom face thereof;

a pivot post extending into said mounting cavity from said bottom face thereof;

a central opening through said circular body portion of said hammer, said central opening being received over said pivot post, with the pivot post having sufficient length to extend completely through said central opening from one side to the other of said circular body portion and project from the other side of said circular body portion;

a cylindrical disc that fits snugly in said mounting cavity adjacent to said hammer, with said cylindrical disc having an outer face that is in alignment with the one side of said frame and an inner face abutting said circular portion of said hammer, with a central bore on said inner face adjacent to said hammer for receiving the end of said pivot post; and means for retaining said cylindrical disc in said mounting cavity.

11. A single shot handgun in accordance with claim 10, wherein the means for retaining said cylindrical disc in said mounting cavity comprises a recessed area cut in the one side of said frame adjacent to said mounting cavity;

a shallow recess cut in the outer face of said cylindrical disc, said shallow recess being in alignment with the recessed area in the one side of said frame;

a retainer plate having a first portion that fits in said recessed area and an integral second portion extending from said first portion, with said second portion fitting in said shallow recess on said cylindrical disc; and means for securing said retainer plate to said frame.

12. A single shot handgun in accordance with claim 3 further including an improved gun sight comprising a base tube having a threaded bore extending from one end to the other end thereof, said base tube being firmly attached along one side thereof to said frame near the rearward end of said receiver so that the threaded bore of said base tube is aligned substantially transverse of the barrel of said handgun when the barrel and receiver are in the battery position;

an elongate slot in the central portion of said base tube, said slot opening upwardly from said threaded bore to an upper side of said base tube opposite the one side of said base tube that is attached to said frame;

a sight blade having a sight notch therein and a tab extending from said blade from a side thereof opposite said sight notch, said blade positioned along the upper side of said base tube, with said tab received in said slot and extending into said threaded bore; and two set screws threaded into said threaded bore from the opposite ends thereof to make firm engagement with the tab on said blade, whereby the set screws can be adjusted to move the sight notch back and forth along a direction substantially transverse of the barrel of said handgun when the barrel and receiver are in the battery position.

13. In a handgun of the type having a barrel, a frame, a firing pin, and a hammer, an improvement in means for mounting the hammer in said frame, said improvement comprising a substantially circular shape mounting cavity extending inwardly into said frame from one side thereof, with the mounting cavity having a flat inner bottom face, such that a circular body portion of the hammer can be received within said mounting cavity and against the bottom face thereof, a recessed area cut into the one side of said frame adjacent to said mounting cavity, a shallow recess cut in the outer face of said cylindrical disc, said shallow recess being in alignment with the recessed area in the one side of said frame, a retainer plate having a first portion that fits in said recessed area and an integral second portion extending from said first portion, with said second portion fitting in said shallow recess on said cylindrical disc, and means for securing said retainer plate to said frame;

a pivot post extending into said mounting cavity from said bottom face thereof;

a central opening through said circular body portion of said hammer, said central opening being received over said pivot post, with the pivot post having sufficient length to extend completely through said central opening from one side to the other of said circular body portion and project from the other side of said circular body portion;

a cylindrical disc that fits snugly in said mounting cavity adjacent to said hammer, with said cylindrical disc having an outer face that is in alignment with the one side of said frame and an inner face abutting said circular portion of said hammer, with a central bore on said inner face adjacent to said hammer for receiving the end of said pivot post; and means for retaining said cylindrical disc in said mounting cavity.

* * * * *